US007722030B2

(12) United States Patent
Sugiyama et al.

(10) Patent No.: US 7,722,030 B2
(45) Date of Patent: May 25, 2010

(54) SHEET FEEDER

(75) Inventors: Wataru Sugiyama, Aichi-ken (JP); Noritsugu Ito, Tokoname (JP); Shingo Ito, Kasugai (JP); Naokazu Tanahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 74 days.

(21) Appl. No.: 11/963,653

(22) Filed: Dec. 21, 2007

(65) Prior Publication Data

US 2008/0150221 A1 Jun. 26, 2008

(30) Foreign Application Priority Data

Dec. 26, 2006 (JP) ..... 2006-350680

(51) Int. Cl.
*B65H 3/06* (2006.01)

(52) U.S. Cl. ..... 271/117

(58) Field of Classification Search ..... 271/116, 271/117, 118

See application file for complete search history.

(56) References Cited

U.S. PATENT DOCUMENTS

| | | | | |
|---|---|---|---|---|
| 5,527,026 | A | 6/1996 | Padget et al. | |
| 2003/0132566 | A1 * | 7/2003 | Tsuei | 271/3.14 |
| 2004/0108647 | A1 | 6/2004 | Iida | |
| 2007/0145670 | A1 * | 6/2007 | Asada | 271/117 |

FOREIGN PATENT DOCUMENTS

| | | | |
|---|---|---|---|
| JP | 3003391 U | | 8/1994 |
| JP | H08-259013 A | | 10/1996 |
| JP | 2003-146455 A | | 5/2003 |
| JP | 2003146455 A | * | 5/2003 |
| JP | 2004-083226 A | | 3/2004 |

* cited by examiner

*Primary Examiner*—Patrick H Mackey
*Assistant Examiner*—Ernesto Suarez
(74) *Attorney, Agent, or Firm*—Baker Botts, LLP.

(57) ABSTRACT

A sheet feeder is provided. The sheet feeder includes a sheet tray which retains a sheet; a first rotating body for applying a first conveying force to the sheet retained in the sheet tray; a second rotating body for applying a second conveying force to the sheet retained in the sheet tray; and a conveying force transfer unit which controls the second rotating body based on whether the first rotating body slips on the sheet.

8 Claims, 7 Drawing Sheets

SHEET FEEDER

CROSS REFERENCE TO RELATED APPLICATION

The present application claims priority from Japanese Patent Application No. 2006-350680, which was filed in the Japanese Patent Office on Dec. 26, 2006, the disclosure of which is herein incorporated by reference in its entirety.

TECHNICAL FIELD

Apparatuses and devices consistent with the present invention relate to sheet feeders and, in particular, to sheet feeders for conveying sheets by using a plurality of rotating bodies.

BACKGROUND

A related art sheet feeder is provided in an image-recording device such as a printer. The related art sheet feeder includes a sheet tray and feed rollers. Sheets placed on the related art sheet tray are separated one by one by the feed rollers, and the separated sheets are fed in the conveying direction.

The above-described related art sheet feeder includes a device which comprises two feed rollers apart in the conveying direction of sheets, as, for example, disclosed in Patent Document 1.

[Patent Document 1] Japanese Published Unexamined Patent Application No. 2003-146455

SUMMARY

Moreover, in related art sheet feeders, a greater conveyance resistance (conveyance friction) is applied to a sheet on conveyance of a wide sheet than on conveyance of a narrow sheet. As a result, there are concerns in the related art that a feed roller may slip on a sheet. Thus, in an attempt to address this problem, Patent Document 1 proposes providing two feed rollers. However, this approach has a disadvantage in that in a mechanism for conveying sheets with two feed rollers, it is impossible to completely synchronize the rotating speed of the two feed rollers. This causes a problem in the case where a sheet is deflected between the two feed rollers or pulled by them. In such a case, the deflected sheet may suffer damage such as creases or cuts.

Exemplary embodiments of the present invention overcome the above disadvantages and other disadvantages not described above. However, the present invention is not required to overcome the disadvantages described above, and thus, an exemplary embodiment of the present invention may not overcome any of the problems described above. Accordingly, it is an aspect of the present invention to provide a sheet feeder capable of conveying a sheet reliably without causing damage where a conveyance resistance is imparted to the sheet.

A sheet feeder according to first aspect of the present invention is a sheet feeder comprising: a sheet tray which retains a sheet; at least one driving source; a first conveying mechanism including a first rotating body which is in contact with a sheet on the sheet tray and a first driving-force transfer mechanism which transfers a driving force of the driving source to the first rotating body; and a second conveying mechanism including a second rotating body which is in contact with the sheet on the sheet tray and a second driving-force transfer mechanism which transfers the driving force of the driving source to the second rotating body; wherein the first rotating body is rotated in a conveying direction of the sheet by the driving force transferred by the first driving-force transfer mechanism, so that the sheet positioned on the sheet tray is conveyed in a predetermined direction at a first speed; the second rotating body is rotated by a friction force between the sheet and the second rotating body, when a conveying speed of the sheet on the sheet tray is greater than a second speed which is smaller than the first speed; and the second rotating body is rotated in the conveying direction of the sheet by the driving force transferred by the second driving-force transfer mechanism, when the conveying speed of the sheet on the sheet tray is smaller than the second speed.

Also, a sheet feeder of second aspect of the present invention is a sheet feeder according to first aspect, wherein the second driving-force transfer mechanism includes a one-way clutch.

Also, a sheet feeder of third aspect of the present invention is a sheet feeder according to second aspect, wherein a peripheral speed of the first rotating body which is driven by the driving source is greater than a peripheral speed of the second rotating body which is driven by the driving source.

Also, a sheet feeder of fourth aspect of the present invention is a sheet feeder according to first aspect, wherein the first conveying mechanism further comprises a first arm member on which the first rotating body is provided so that the first rotating body may rotate; the second conveying mechanism further comprises a second arm member on which the second rotating body is provided so that the second rotating body may rotate.

Also, a sheet feeder of fifth aspect of the present invention is a sheet feeder according to fourth aspect, wherein an angle of an extending direction of the second arm member with respect to a surface of the sheet positioned on the sheet tray is greater than an angle of an extending direction of the first arm member with respect to the surface of the sheet positioned on the sheet tray.

Also, a sheet feeder of sixth aspect of the present invention is a sheet feeder according to first aspect, wherein the second rotating body is disposed separate from and upstream of the first rotating body in the conveying direction of the sheet.

Also, a sheet feeder of seventh aspect of the present invention is a sheet feeder according to first aspect, wherein the second conveying mechanism further comprises a speed detecting mechanism which detects a conveying speed of the sheet positioned on the sheet tray.

Also, a sheet feeder of eighth aspect of the present invention is a sheet feeder according to seventh aspect, wherein the second conveying mechanism further comprises a solenoid which switches whether the driving force of the driving source is transferred to the second rotating body.

Also, a sheet feeder of ninth aspect of the present invention is a sheet feeder according to seventh aspect, wherein the speed detecting mechanism detects a rotation speed of the second rotating body.

Also, a sheet feeder of tenth aspect of the present invention is a sheet feeder according to ninth aspect, wherein the speed detecting mechanism detects a rotation speed of the first rotating body and compares the rotation speed of the first rotating body with the rotation speed of the second rotating body.

According to an exemplary embodiment of the present invention, a sheet feeder is provided wherein if the first rotating body slips on a sheet, a conveying force is imparted to the sheet from the second rotating body and where the first rotating body does not slip on a sheet, a conveying force is imparted to the sheet only by the first rotating body.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION OF EXEMPLARY EMBODIMENTS OF THE PRESENT INVENTION

Hereinafter, a description will be given of exemplary embodiments of the present invention with reference to the drawings. It is noted that the embodiments to be described below are only an example of embodiments of the present invention and, as a matter of course, these exemplary embodiments can be modified whenever necessary, within a scope not departing from the spirit of the present invention as defined in the following claims.

Embodiment 1

Figure 1:
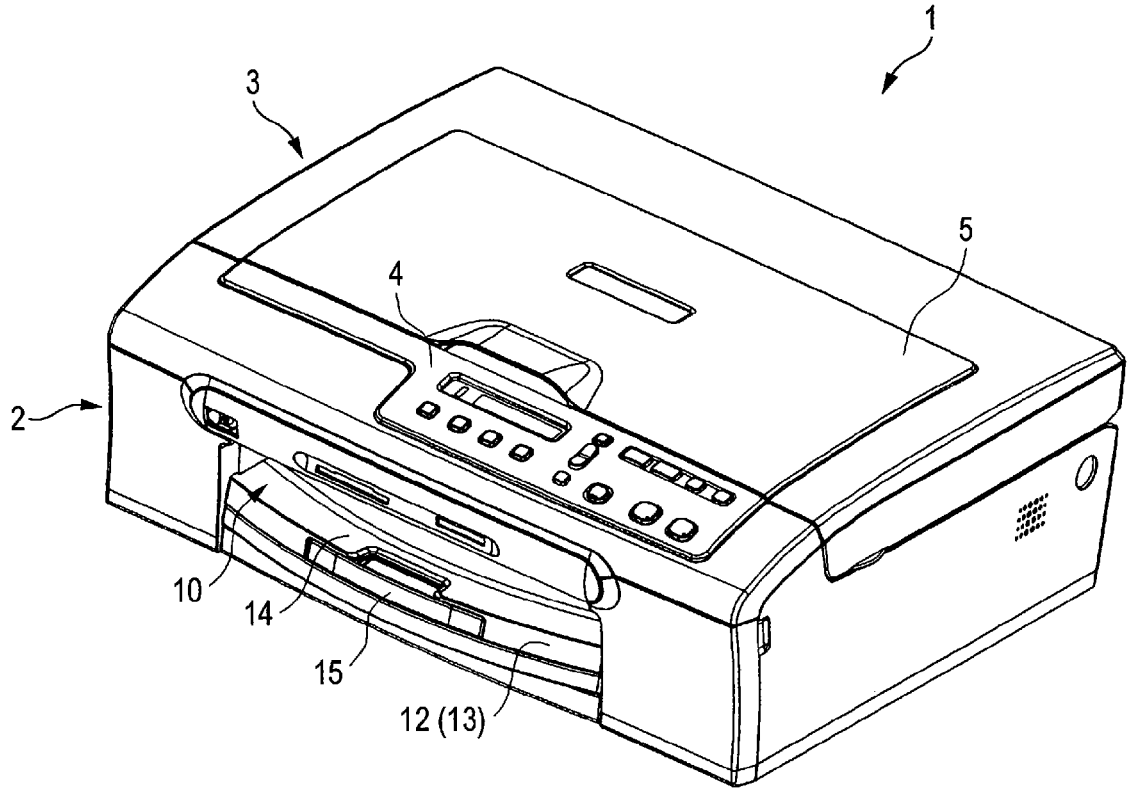
FIG. 1 is a perspective view showing a multi function device according to an exemplary embodiment of the present invention.

FIG. 1 shows a perspective view of a multi function device according to an exemplary embodiment of the present invention. A multi function device 1 (MFD) comprises a printer portion 2 and a scanner portion 3, and the multi function device 1 has a print-function, a scan-function, a copy-function, and a facsimile-function. However, the multi-function device 1 is not limited to these functions, and one of ordinary skill in the art will appreciate that the multi-function device 1 may have additional portions and/or may provide additional related functions.

The multi function device 1 has a substantially rectangular shape which is greater in width and depth than height, with an upper part of the multi function device 1 being a scanner portion 3. The scanner portion 3 is constituted as a so-called flat bed scanner. As shown in FIG. 1, a document cover 5 is provided so as to open and close freely as a top plate of the multi function device 1. A platen glass and an image sensor are provided below the document cover 5. A document placed on the platen glass is read for images by the image sensor.

The lower part of the multi function device 1 is a printer portion 2. The printer portion 2 records images and text on recording sheets on the basis of print data including image data and/or text data input externally. An opening 10 is formed on the front face of the printer portion 2. An upper sheet feed tray 12, a lower sheet feed tray 13 and a sheet discharging tray 14 are vertically provided in a stage-like manner inside the opening 10. In this exemplary embodiment, the upper sheet feed tray 12, the lower sheet feed tray 13 and the sheet discharging tray 14 are respectively assembled into an integrated sheet feed cassette.

Recording sheets are stacked and accommodated in the upper sheet feed tray 12 and the lower sheet feed tray 13. The respective trays may accommodate recording sheets with different dimensions. For example, A4 size sheets may be accommodated in one of the trays and sheets smaller than A4 size such as B5 size or postcard size can be accommodated in the lower sheet feed tray 13. As an alternative example, recording sheets with small dimensions such as postcard size or photo L size can be accommodated in the upper sheet feed tray 12. The tray face of the lower sheet feed tray 13 may be extended by pulling out a slide tray 15, thereby making it possible to accommodate, for example, legal-size recording sheets. Recording sheets accommodated in the upper sheet feed tray 12 and the lower sheet feed tray 13 are fed inside the printer portion 2 to record desired images, and sheets are discharged to the sheet discharging tray 14. It is noted that the printer portion 2 and the scanner portion 3 are activated on the basis of operational instructions given from an operation panel 4 provided on an upper part of the front face of the multi function device 1 and/or instructions sent from a computer via a printer driver or a scanner driver.

Figure 2:
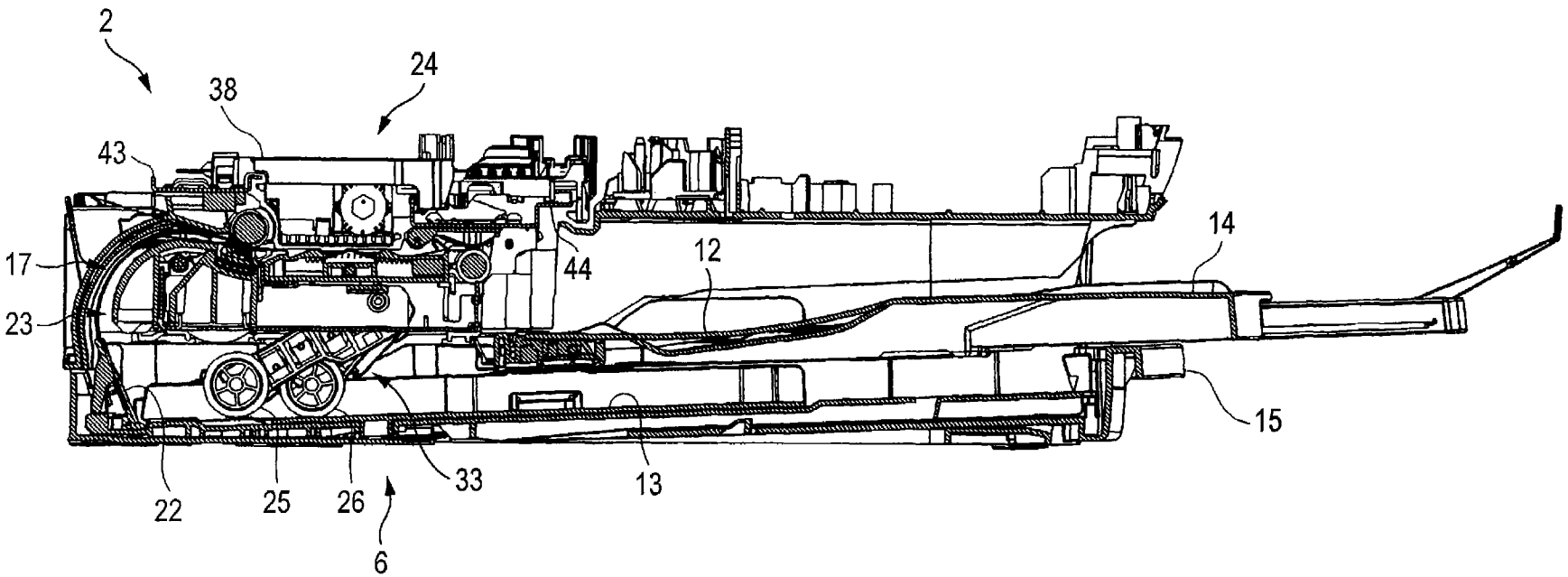
FIG. 2 is a longitudinal sectional view showing a printer portion of the multi function device of FIG. 1 according to an exemplary embodiment of the present invention.
Figure 3:
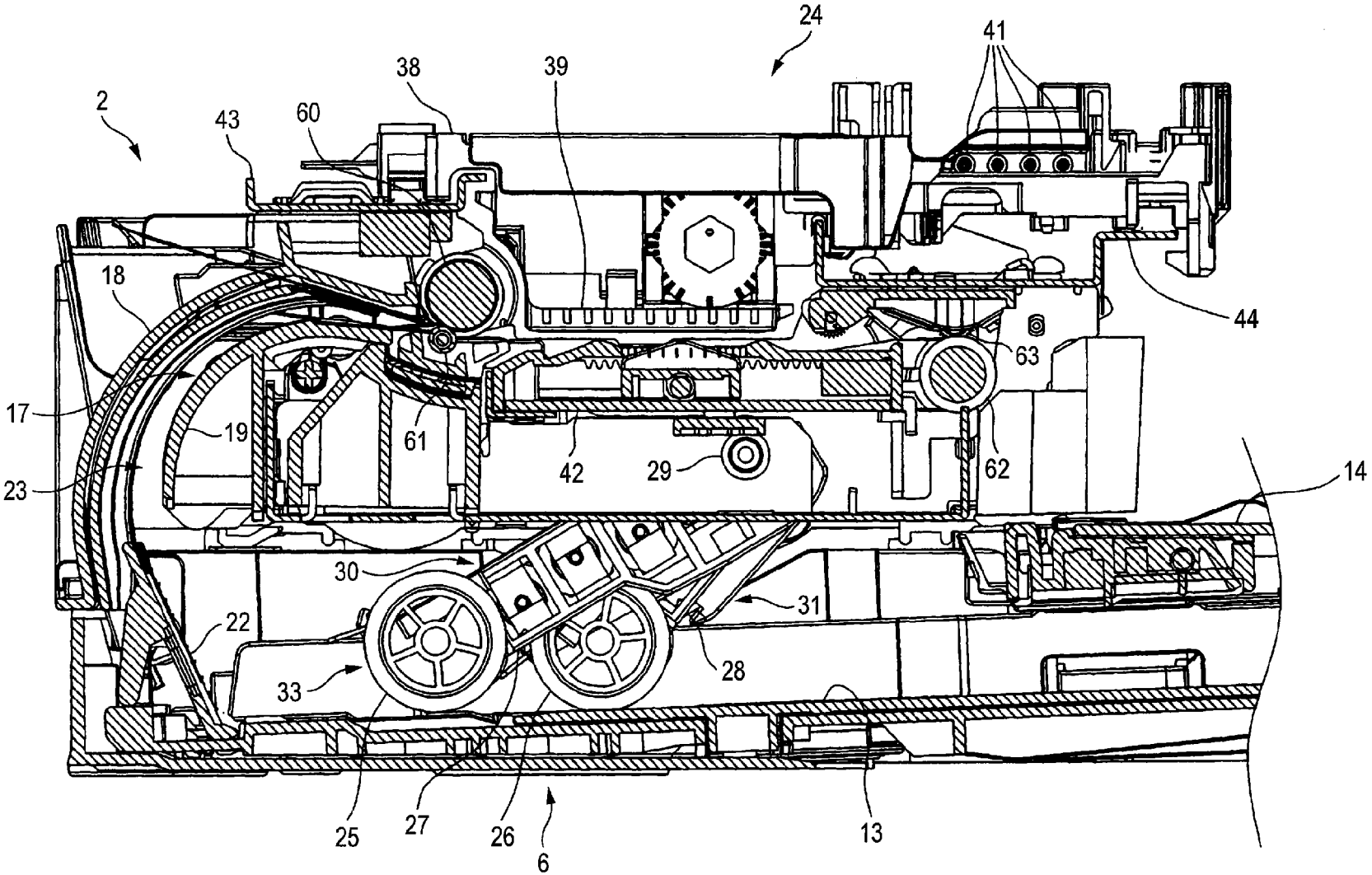
FIG. 3 is a partially enlarged sectional view showing a sheet feeding device of the printer portion of FIG. 2 according to an exemplary embodiment of the present invention.

Hereinafter, with reference to FIG. 2 and FIG. 3, a description will be given of the printer portion 2 of the multi-function device. FIG. 2 is a longitudinal sectional view showing the printer portion 2 of the multi function device 1 according to an exemplary embodiment of the present invention. FIG. 3 is a partially-enlarged sectional view showing the sheet feeding device 6 of the printer portion 2 of FIG. 2 according to an exemplary embodiment of the present invention.

The printer portion 2 comprises the sheet feeding device 6. The sheet feeding device 6 comprises the upper sheet feed tray 12, the lower sheet feed tray 13 and a sheet feeding mechanism 33. As seen best in FIG. 3, the sheet feeding mechanism 33 comprises a first feed roller 25, a second feed roller 26, first and second driving-force transfer mechanisms 30, 31, a first swing arm 27 for supporting the first feed roller 25 and the second feed roller 26 and a second swing arm 28

Returning to FIG. 2, the lower sheet feed tray 13 is provided at the bottom of the printer portion 2. The upper sheet feed tray 12 is provided at the upper side thereof. In other words, the upper sheet feed tray 12 and the lower sheet feed tray 13 are a two-stage vertical structure. The first feed roller 25 and the second feed roller 26 are attached within the printer portion 2 above the upper sheet feed tray 12 and the lower sheet feed tray 13. FIG. 2 shows a state that the first feed roller 25 and the second feed roller 26 are in contact with the lower sheet feed tray 13. In a state in which the upper sheet feed tray 12 and the lower sheet feed tray 13 are both installed, the upper sheet feed tray 12 is drawn out relatively with respect to the lower sheet feed tray 13, by which the first feed roller 25 and the second feed roller 26 are brought into contact with the lower sheet feed tray 13. By contrast, in the case in which the upper sheet feed tray 12 is pushed into the device in the depth direction relatively with respect to the lower sheet feed tray 13, a leading edge of the upper sheet feed tray 12 flips up the first feed roller 25 and the second feed roller 26, and the roller faces thereof are brought into contact with the upper sheet feed tray 12. Hereinafter, a description will be given for the sheet feeding device 6 in the case in which the state of the upper sheet feed tray 12 and the lower sheet feed tray 12 are positioned as shown in FIG. 2. In other words, for descriptive purposes of this exemplary embodiment, a two-stage sheet feed tray structure is adopted such as that shown in FIG. 2. However, as a matter of course, a one-stage sheet feed tray structure may also be used in accordance with the present invention.

As shown in FIG. 2 and FIG. 3, an inclined separation plate 22 is provided at the back of the lower sheet feed tray 13. The inclined separation plate 22 separates recording sheets sent in a superimposed manner from the lower sheet feed tray 13, thus guiding upward the outermost (i.e., the topmost) recording sheet of the lower sheet feed tray 13. After extending upward from the inclined separation plate 22, the sheet conveying path 23 turns to the front face via a curved portion 17 formed in a curved manner. Thus, the sheet conveying path 23 extends from the back side of the multi function device 1 to the front face, and leads to the sheet discharging tray 14 via the image recording unit 24. Therefore, recording sheets accommodated in the lower sheet feed tray 13 are guided by the sheet conveying path 23 so as to make a U turn from below to above into the image recording unit 24. After images pass through the image recording unit 24, the recording sheet is discharged to the sheet discharging tray 14.

As shown in FIG. 3, the roller faces of the first feed roller 25 and the second feed roller 26 are in contact with the upper face of the lower sheet feed tray 13. When a recording sheet is present in the lower sheet feed tray 13, the roller faces of the first feed roller 25 and the second feed roller 26 are in contact with the surface of the recording sheet. In this instance, the recording sheet in the lower sheet feed tray 13 is supplied to the sheet conveying path 23 by the first feed roller 25 and the second feed roller 26. As shown in the drawing, the first feed roller 25 and the second feed roller 26 are connected to a driving shaft 29 by first and second swing arms 27, 28 respectively so as to sway freely, and a driving force input from the driving shaft 29 is transferred by the first and second driving-force transfer mechanisms 30, 31 to the first feed roller 25 and the second feed roller 26, respectively. Thereby, both the first feed roller 25 and the second feed roller 26 communicate with the recording sheet, thereby reducing a transfer loss of a conveying force imparted to the recording sheet. It is noted that a more detailed description will be given later for the supporting mechanism and the first and second driving-force transfer mechanisms 30, 31 of the first feed roller 25, the second feed roller 26.

The sheet conveying path 23 is formed by an outer guide face and an inner guide face opposing each other at an interval at portions other than those where the image recording unit 24 and others are disposed. The interval may be predetermined. For example, a curved portion 17 of the sheet conveying path 23 at the back of the multi function device 1 is constituted with an outer guide member 18 and an inner guide member 19 fixed to a frame of the multi-function device 1. When the recording sheet is conveyed to the curved portion 17, the recording sheet is bent in a curved form by the curved portion 17. Therefore, when the recording sheet passes over the curved portion 17, the recording sheet moves in contact with the guide face of the outer guide member 18, thereby receiving a conveyance friction (i.e., a frictional resistance force) from the guide face in a direction reverse to the conveying direction. There is a tendency that the conveyance friction is greater particularly in a case where the recording sheet to be conveyed is thick paper which is elastically strong or glossy paper the recording surface of which is processed with a coating processing.

As shown in FIG. 3, an image recording unit 24 is provided in the sheet conveying path 23. The image recording unit 24 comprises a carriage 38. The carriage 38 comprises an inkjet recording head 39. Guide rails 43, 44 are extended in a main scanning direction (a direction perpendicular to the sheet space of FIG. 3) which is orthogonal with the conveying direction of the recording sheet. The carriage 38 is supported by the guide rails 43, 44 so as to move reciprocally in the main scanning direction. Various colors of ink are supplied to the inkjet recording head 39 through ink tubes 41 from ink cartridges arranged inside the multi function device 1 independently of the inkjet recording head 39. Various colors of ink are ejected selectively as minute ink droplets from the inkjet recording head 39, while the carriage 38 moves reciprocally, by which images are recorded on the recording sheet conveyed on a platen 42.

As shown in FIG. 3, a conveying roller 60 and a pinch roller 61 are disposed at an upstream side of the image recording unit 24. The pinch roller 61 is disposed below the conveying roller 60 in pressure contact with the conveying roller 60. A recording sheet which is conveyed on the sheet conveying path 23 is caught between the conveying roller 60 and the pinch roller 61 and conveyed onto the platen 42. A discharge roller 62 and a spur roller 63 are disposed at a downstream side of the image recording unit 24, and the discharge roller 62 and the spur roller 63 are in pressure contact. Recording sheets on which images have been recorded are caught between the discharge roller 62 and the spur roller 63 and conveyed to the sheet discharging tray 14. The conveying roller 60 and the discharge roller 62 are driven intermittently at a linefeed width, which may be predetermined, when a driving force is transferred from a motor 71 (shown in FIG. 5).

Figure 4:
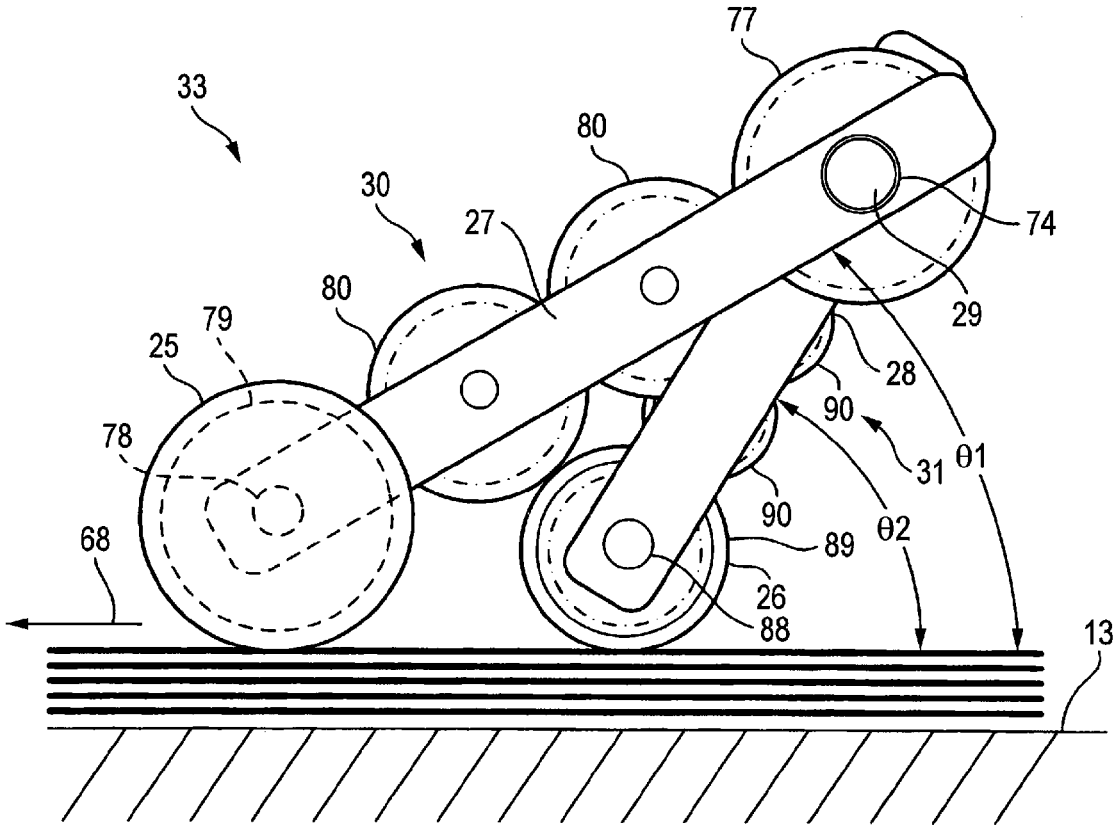
FIG. 4 is an enlarged pattern diagram showing a sheet feeding mechanism according to an exemplary embodiment of the present invention.
Figure 5:
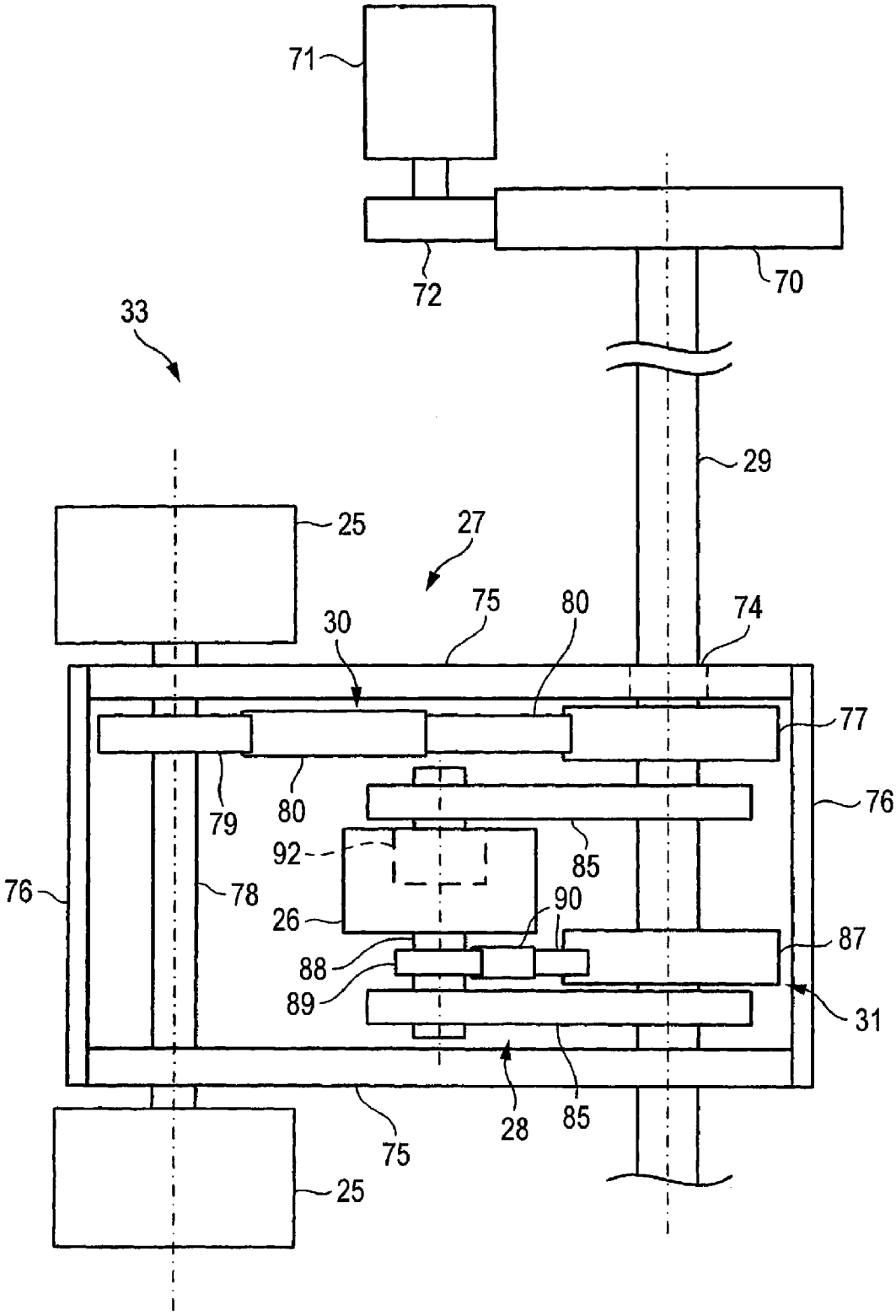
FIG. 5 is a plan view of the sheet feeding mechanism shown in FIG. 4.

Hereinafter, with reference to FIG. 4 and FIG. 5, a description will be given of the sheet feeding mechanism 33, the supporting mechanism, and the first and second driving-force transfer mechanisms 30, 31 of the first feed roller 25 and second feed roller 26, respectively, according to an exemplary embodiment of the present invention. In this instance, FIG. 4 is an enlarged pattern diagram for showing the sheet feeding mechanism 33. Further, FIG. 5 is a plan view of the sheet feeding mechanism 33 shown in FIG. 4.

The sheet feeding mechanism 33 comprises the first feed roller 25, the second feed roller 26, the first driving-force transfer mechanism 30, the second driving-force transfer mechanism 31, the first swing arm 27 and the second swing arm 28. The first driving-force transfer mechanism 30 further comprises a plurality of gears and the second driving-force transfer mechanism 31 also comprises a plurality of gears. The first feed roller 25 and the plurality of gears constituting the first driving-force transfer mechanism 30 are connected to the first swing arm 27, and the second feed roller 26 and the plurality of gears constituting the second driving-force transfer mechanism 31 are connected to the second swing arm 28.

A driving shaft 29 is provided above the upper sheet feed tray 12. The driving shaft 29 runs the width of the multi-function device 1. A main body frame of the multi function device 1 supports the driving shaft 29 so that the driving shaft 29 may rotate freely. As shown in FIG. 5, a transfer gear 70 is connected to one end of the driving shaft 29. The transfer gear 70 is meshed with a transfer gear 72 directly connected to the motor 71. Therefore, when a motor 71 is driven and rotated, a rotational driving force (i.e., a rotational torque) in a predetermined direction is transferred to the driving shaft 29 via the transfer gear 72 and the transfer gear 70. In this exemplary embodiment, as shown in FIG. 4, a counter-clockwise rotational driving force is transferred to the driving shaft 29 by the motor 71. However, the rotational driving force may be in the clockwise rotational direction, depending on the arrangement of the plurality of the gears of the first and second driving-force transfer mechanisms 30, 31.

The first swing arm 27 is formed by two plate members 75. The plate members 75 are made of synthetic-resin. However, any material that provides adequate structural support may be used. The two plate members 75 are disposed facing each other at an interval, which may be predetermined, and are connected together at each end by a rib 76 between both ends of the respective long plate members 75. As shown in FIG. 4, one end of the first swing arm 27 is connected to the driving shaft 29 so that the other end of the first swing arm 27 may move rotationally about the driving shaft 29. Specifically, the driving shaft 29 is inserted through a shaft hole 74 formed in the one end of the first swing arm 27.

The first feed roller 25 is connected to the other end of the first swing arm 27. Specifically, two first feed rollers 25 are connected respectively to each end of a first supporting shaft 78 connected to the other end (i.e., the leading end) of the first swing arm 27 so that the first swing arm 27 may move rotationally. For example, as shown in FIG. 5, in this exemplary embodiment, each of the first feed rollers 25 is connected outside of a respective plate member 75. The roller face of the first feed roller 25 is covered with a rubber member so as to easily supply a friction force to a recording sheet when the first feed roller 25 is in communication with the recording sheet.

As shown in FIG. 4, the first driving-force transfer mechanism 30 comprises a plurality of gears, the plurality of gears including a first transfer gear 77, first and second intermediate gears 80, 81, and a second transfer gear 79. The first transfer gear 77 is fitted on the driving shaft 29 inside the plate member 75. The first transfer gear 77 is firmly fixed to the driving shaft 29 and thus rotates in a same direction as the driving shaft 29. The second transfer gear 79 is fitted to the supporting shaft 78 inside the plate members 75. The second transfer gear 79 is firmly fixed to the first supporting shaft 78 and thus rotates in a same direction as the first supporting shaft 78. The first and second intermediate gears 80,81 are installed serially between the first transfer gear 77 and the second transfer gear 79. Thereby, a rotational driving force input into the driving shaft 29 is transferred to first feed rollers 25 via the first transfer gear 77, the intermediate gears 80,81 and the second transfer gear 79.

The first swing arm 27 is supported by the driving shaft 29 so as to move rotationally. Therefore, the first swing arm 27 is allowed to move rotationally downward by the weight of the first swing arm 27, the first feed roller 25 and the first driving-force transfer mechanism 30 as well as a spring force resulting from a spring and halted at a position at which the face of the first feed roller 25 is in contact with the recording sheets. As shown in FIG. 4, the first swing arm 27 is inclined in a direction which makes an angle θ1 with respect to the surface of the recording sheets. In other words, a direction of the first swing arm 27 extended from the driving shaft 29 is related to the surface of the recording sheet so as to make the angle θ1. When a rotational driving force (rotational torque) is transferred to the first feed roller 25, with the first swing arm 27 in this state, a friction force is generated between the roller face and the recording sheet, by which the recording sheet is conveyed so as to be picked up in the direction indicated by the arrow 68. In other words, the above described friction force is imparted to the recording sheet, and the recording sheet is conveyed by the friction force. Thus, the friction force denotes a conveying force.

As shown in FIG. 4 and FIG. 5, the second swing arm 28 comprises two plate members 85 which are shorter than the two plate members 75 of the first swing arm 27. The two plate members 85 of the second swing arm 28 are arranged to face each other at an interval. The interval may be predetermined. A first end of the second swing arm 28 is supported to the driving shaft 29 so that the second swing arm 28 may move rotationally. Specifically, the driving shaft 29 is inserted through a shaft hole (not shown) formed in the first end of the second swing arm 28. The two plate members 85 are disposed between the plate members 75 of the first swing arm 27.

The second feed roller 26 is provided at a second end (i.e., the leading end) of the second swing arm 28. Specifically, the second feed roller 26 is connected to a second supporting shaft 88 provided at the leading end of the second swing arm 28 so that the second swing arm 28 may move rotationally. In this exemplary embodiment, the second feed roller 26 is connected inside of the two plate members 85, as shown in FIG. 5. A rubber member is provided on a roller face of the second feed roller 26 so as to give a friction force easily when in sliding contact with a recording sheet.

The second driving-force transfer mechanism 31 comprises a plurality of gears. The plurality of gears comprises a first transfer gear 87, first and second intermediate gears 90, 91 and a second transfer gear 89. The first transfer gear 87 of the second driving-force transfer mechanism 31 has a same diameter as the first transfer gear 77 of the first driving-force transfer mechanism 30. The first transfer gear 87 of the second driving-force transfer mechanism 31 has a same number of teeth as the first transfer gear 87 of the second driving-force transfer mechanism 31. The first transfer gear 87 is connected to the driving shaft 29 inside the two plate members 85. The first transfer gear 87 is firmly fixed to the driving shaft 29 and rotates in a same direction as a rotation of the driving shaft 29. The second transfer gear 89 is connected to the second supporting shaft 88 inside the two plate members 75. The second transfer gear 89 is firmly fixed to the second supporting shaft 88 and rotates in a same direction as the rotation of the second supporting shaft 88. The first and second intermediate gears 90, 91 are provided serially between the first transfer gear 87 and the second transfer gear 89. Thereby, a rotational driving force input into the driving shaft 29 is transferred to the second feed roller 26 via the first transfer gear 87, the first and second intermediate gears 90, 91 and the second transfer gear 89 of the second driving-force transfer mechanism 31.

The second driving-force transfer mechanism 31 also comprises a one-way clutch 92. As shown in FIG. 5, the one-way clutch 92 is installed so as to be accommodated into an inner hole of the second feed roller 26. The one-way clutch 92 is a clutch which transfers a rotational driving force (i.e., a rotational torque) to the second feed roller 26 when the rotational driving force, which conveys recording sheets in the direction indicted by the arrow 68, is transferred to the second supporting shaft 88 and does not transfer the rotational driving force to the second feed roller when a rotational driving force in a direction reverse to that indicated by the arrow 68 is transferred to the second supporting shaft 88. Instead, when the rotational driving force in the direction reverse to that indicated by the arrow 68 is transferred to the second supporting shaft 88, the one-way clutch 92 slips. The effects and actions of the one-way clutch 92 will be described in more detail later.

The second swing arm 28 is connected to the driving shaft 29 so that the second swing arm 28 may move rotationally. Therefore, the second swing arm 28 is allowed to move rotationally downward by the weight of the second swing arm 28, the second feed roller 26 and the second driving-force transfer mechanism 31 as well as a spring force resulting from a spring (not shown) and halts at a position at which the face of the second feed roller 26 is in contact with the recording sheets. The second swing arm 28 is shorter in the direction extended from the driving shaft 29 than the first swing arm 27. Therefore, as shown in FIG. 4, the second swing arm 28 extended from the driving shaft 29 is inclined in a direction which forms an angle θ2 with respect to the surface of the recording sheets. The angle θ2 is greater than the angle θ1, which is formed by the first swing arm 27 described above. In other words, a direction of the second swing arm 28 extended from the driving shaft 29 is related to the surface of the recording sheets so as to form the angle θ2. When a rotational driving force (i.e., a rotational torque) is transferred to the second feed roller 26, with this state kept, a friction force is generated between the roller face and the recording sheets, and the friction force is imparted to the recording sheets as a conveying force to convey the recording sheet in the direction indicated by the arrow 68. In this instance, since the angle θ2 is greater than the angle θ1, a conveying force imparted from the second feed roller 26 to the recording sheets is greater than a conveying force imparted from the first feed roller 25 to the recording sheets.

In this exemplary embodiment, the transfer gears of the respective first and second driving-force transfer mechanisms 30, 31 are appropriately designed in diameter and number of teeth, or the first feed roller 25 and the second feed roller 26 are appropriately designed in outer peripheral length, in order to produce a peripheral speed $V_1$ of the first feed roller 25 that is greater than a peripheral speed $V_2$ of the second feed roller 26. For example, where each of the transfer gears comprising the first and second driving-force transfer mechanisms 30 and 31 is the same in structure, an outer diameter of the first feed roller 25 is made greater than an outer diameter of the second feed roller 26, thus making it possible to set the peripheral speed $V_1$ greater than peripheral speed $V_2$. Alternatively, where the outer diameter of the first feed roller 25 is the same as the outer diameter of the second feed roller 26, the diameter and number of gears of the transfer gears of the first driving-force transfer mechanism 30 may be increased relative to the diameter and number of gears of the second driving-force transfer mechanism 31 in order to set the peripheral speed V1 greater than the peripheral speed V2.

Since the sheet feeding mechanism 33 is constituted as described above, a rotational driving force is transferred from the driving shaft 29 via the first driving-force transfer mechanism 30 to the first feed roller 25. Thereby, the first feed roller 25 is rotated at a peripheral speed $V_1$. Further, a rotational driving force which rotates the second feed roller 26 at the peripheral speed $V_2$ slower than the peripheral speed $V_1$ is transferred to the second supporting shaft 88 via the second driving-force transfer mechanism 31. In this instance, a recording sheet is conveyed in the conveying direction indicated by the arrow 68 (refer to FIG. 4) by a conveying force imparted from the first feed roller 25. On the other hand, a rotational driving force which rotates the second feed roller 26 at the peripheral speed $V_2$ is transferred also to the second supporting shaft 88 from the second driving-force transfer mechanism 31. However, a rotational force imparted to the second feed roller 26 from the recording sheet conveyed by the first feed roller 25 is greater than the rotational driving force transferred to the second supporting shaft 88, thereby a rotational force which rotates the second feed roller 26 at the peripheral speed $V_1$ the same as the first feed roller 25 is imparted from the recording sheet to the roller face of the second feed roller 26. Specifically, the second feed roller 26 is rotated not at the peripheral speed $V_2$ but at the peripheral speed $V_1$ upon receipt of the rotational force from the recording sheet. In this instance, the second supporting shaft 88 is to be rotated reversely and relatively with respect to the second feed roller 26. In other words, by appearance, a rotational driving force in a direction reverse to the direction conveying the recording sheet (the direction given by the arrow 68) is imparted to the second supporting shaft 88 of the second feed roller 26. In this instance, the one-way clutch 92 slips and the rotational driving force transferred to the second supporting shaft 88 is not transferred to the second feed roller 26. As described above, where a recording sheet is conveyed by the first feed roller 25 (i.e., where the first feed roller 25 does not slip), the second feed roller 26 which is to be rotated at the peripheral speed $V_2$ is in contact with the recording sheet conveyed by the first feed roller 25 and rotated together at the peripheral speed $V_1$ which is the same as the first feed roller 25. That is, when a sheet on the sheet tray is conveyed by the first feed roller 25 at a speed which is greater than the peripheral speed $V_2$, the second feed roller 26 is rotated by a friction force between the sheet and the second feed roller 26. Therefore, there is no chance that a load in a direction reverse to the conveying direction is applied to the recording sheet from the second feed roller 26. As a result, the recording sheet is free from creases or cuts.

Moreover, upon conveyance of a recording sheet which may be wide or thick, there is a case where a conveyance resistance (i.e., a conveyance friction) applied to the recording sheet at the curved portion 17 is greater than a conveying force of the first feed roller 25. In this instance, the conveying force of the first feed roller 25 is insufficient and the first feed roller 25 slips on the surface of the recording sheet. In this instance, a conveying speed of the recording sheet decreases from $V_1$ to less than $V_2$. Then, the second supporting shaft 88 of the second feed roller 26 is rotated in a direction which rotates the second feed roller 26 in the conveying direction indicated by the arrow 68 (refer to FIG. 4) together with the second feed roller 26. In this instance, a rotational driving force transferred by the one-way clutch 92 to the second supporting shaft 88 is transferred to the second feed roller 26. Thereby, the second feed roller 26 which is rotated together with the recording sheet is positively rotated at the peripheral speed $V_2$ by the rotational driving force transferred from the shaft 88, and the conveying speed of the recording sheet maintained at least substantially $V_2$. As described above, the conveying force imparted by the second feed roller 26 to the recording sheet is greater than the conveying force of the first feed roller 25, thereby the recording sheet may not stopped by the conveyance resistance but can be conveyed without fail. Therefore, since the multi function device 1 is provided with the sheet feeding mechanism 33, where a recording sheet such as thick paper and gloss paper is conveyed, it is possible to constantly convey the recording sheet without fail, irrespective of the conveyance resistance applied to the recording sheet. To reduce the change of the conveying speed of the recording sheet, the speed $V_2$ may be slightly (eg. between 1 percent and 5 percent) smaller than $V_1$.

Embodiment 2

Figure 6:
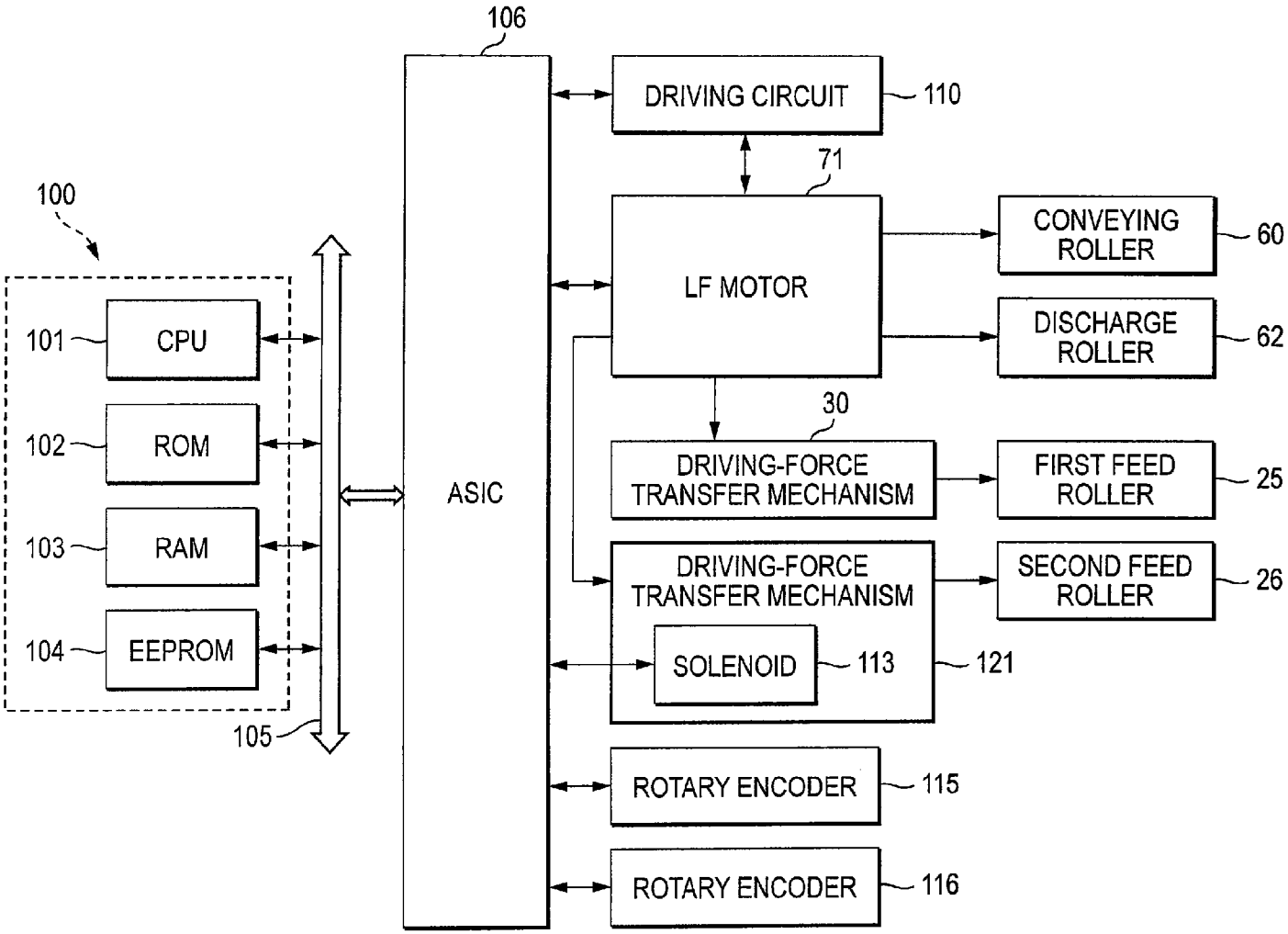
FIG. 6 is a block diagram showing a controller of the sheet feeding device according to an exemplary embodiment of the present invention.
Figure 7:
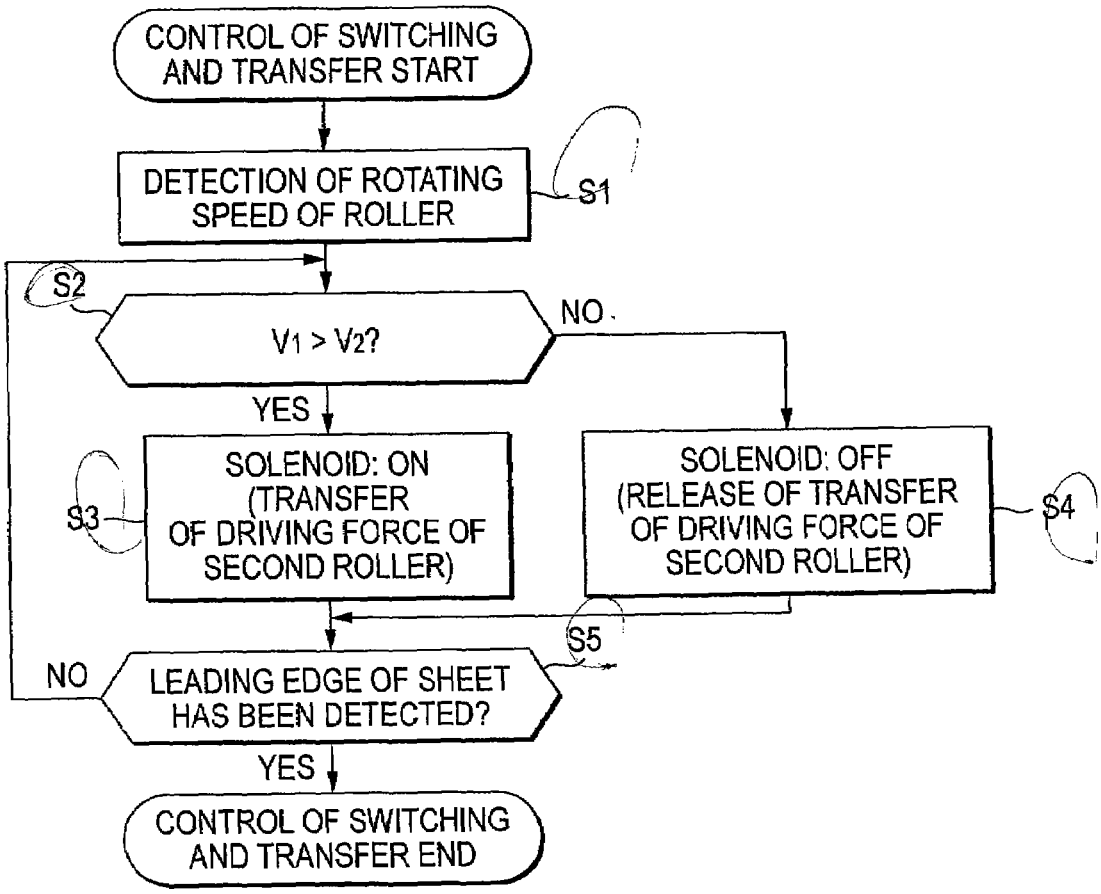
FIG. 7 is a flow chart showing a process for switching and controlling a driving-force transfer mechanism according to an exemplary embodiment of the present invention.

Hereinafter, a description will be given for another exemplary embodiment of the present invention with reference to FIG. 6 and FIG. 7. FIG. 6 is a block diagram showing a controller 100 of a sheet feeding device according to an exemplary embodiment of the present invention. FIG. 7 is a flow chart showing a processing procedure for switching and controlling a driving-force transfer mechanism according to an exemplary embodiment of the present invention. In this exemplary embodiment of the present invention, a controller 100 of the sheet feeding device 6 is independent of a main controller for controlling comprehensively a whole part of the multi function device 1. However, the controller 100 may alternatively be incorporated within the main controller. Further, in the description that follows, parts of this exemplary embodiment which are in common with the exemplary embodiment described above will be given the same reference numbers and a detailed description thereof will be omitted.

As shown in FIG. 6, a controller 100 comprehensively controls an entire motion of the multi function device 1 including not only a printer portion 3 but also a scanner portion 2 (as shown, for example, in FIG. 1. As shown in FIG. 6, the controller 100 is comprises a micro computer comprising a CPU 101, a ROM 102, a RAM 103 and an EEPROM 104, and the controller 100 is coupled to an Application Specific Integrated Circuit (ASIC) 106 via a bus 105.

The ROM 102 accommodates programs and other information for controlling various motions of the multi function device 1. The RAM 103 is used as a storage area and a work area which temporarily stores various data used for execution of the programs by the CPU 101. Further, the EEPROM 104 accommodates various settings and flags to be retained after a power source is turned off.

The ASIC 106 generates a phase excitation signal for energizing a motor 71 according to a command from the CPU 101, and provides the signal to a driving circuit 110 of the motor 71, energizing a driving signal via the driving circuit 110 to the motor 71, thereby performing the rotation control of the motor 71.

The driving circuit 110 drives the motor 71 which is connected to the first feed roller 25 and the second feed roller 26. The drive circuit 110 generates an electric signal for rotating the motor 71 upon receipt of an output signal from the ASIC 106. The motor 71 rotates upon receipt of the electric signal, and a rotational driving force of the motor 71 is transferred to the first feed roller 25 and the second feed roller 26 via the driving shaft 29, the first driving-force transfer mechanism 30 and a driving-force transfer mechanism 121. The motor 71 is also connected to a conveying roller 60 and a discharge roller 62 (refer to FIG. 3) via a driving mechanism made up of gears, driving shafts and others. Therefore, the rotational driving force of the motor 71 is transferred to the conveying roller 60 and the discharge roller 62. In this exemplary embodiment, the driving-force transfer mechanism 121 replaces the driving-force transfer mechanism 31 of the above-described exemplary embodiment and transfers a rotational driving force of the driving shaft 29 to the second feed roller 26. The driving-force transfer mechanism 121 is similar to the driving-force transfer mechanism 31 except that a solenoid 113 is used in place of the one-way clutch 92.

The ASIC 106 is coupled to a first rotary encoder 115 and a second rotary encoder 116. The first rotary encoder 115 detects a rotational quantity of the first feed roller 25 and the second rotary encoder 116 detects a rotational quantity of the second feed roller 26. The CPU 101 calculates a rotating speed $V_1$, of the first feed roller 25 and a rotating speed $V_2$, of the second feed roller 26 on the basis of the rotational quantity of each of the first and second rotary encoders 115, 116, respectively.

The ASIC 106 is coupled to the solenoid 113. The CPU 101 controls the ASIC 106 to output an output signal at a timing on the basis of control programs accommodated in the ROM 102, thereby activating the solenoid 113. The timing may be predetermined. The solenoid 113 is assembled into the driving-force transfer mechanism 121. The solenoid 113 connects or separates an intermediate gear 90 and a transfer gear 89 connected to the second feed roller 26 or detaches the intermediate gear 90 therefrom, and a solenoid shaft is connected via a known link mechanism either to the transfer gear 89 or the intermediate gear 90. When a signal is input into the solenoid 113, the solenoid 113 moves in a direction at which the transfer gear 89 is meshed with the intermediate gear 90. Thereby, a rotational driving force is transferred to the second feed roller 26. Further, in a state that no signal is output to the solenoid 113, the transfer gear 79 is disengaged from the intermediate gear 90. Therefore, in this state, no rotational driving force is transferred to the second feed roller 26.

Turning now to FIG. 7, a description will be given of a processing procedure for switching and controlling a driving force transmission. This processing procedure may be executed after a print command is input and the motor 71 is driven and rotated.

In operation S1, a rotating speed $V_1$ of the first feed roller 25 and a rotating speed $V_2$ of the second feed roller 26 are detected. These rotating speeds $V_1$ and $V_2$ are detected on the basis of rotational quantities of the rotary encoders 115 and 116.

In operation S2, it is determined whether the rotating speed $V_1$ is greater than the rotating speed $V_2$. Where the first feed roller 25 does not slip, the second feed roller 26 is also rotated together with the recording sheet at a speed $V_1$ which is the same as the speed of the first feed roller 25. Therefore, the rotating speed $V_1$ will not exceed the rotating speed $V_2$. On the contrary, where the first feed roller 25 slips, recording sheet is conveyed at a speed slower than the rotating speed $V_1$. Alternatively, the recording sheet is not conveyed but stopped, by which the second feed roller 26 is decreased in rotating speed or the recording sheet is stopped. On the other hand, the first feed roller 25 is rotated at the rotating speed $V_1$ in the midst of slippage. Therefore, in this instance, the rotating speed $V_1$ is greater than the rotating speed $V_2$. In other words, in operation S2, the rotating speed $V_1$ is compared with the rotating speed $V_2$, thereby making it possible to determine whether the first feed roller 25 slips.

In operation S2, if it is determined that the rotating speed $V_1$ is greater than the rotating speed $V_2$, the CPU 101 of the controller 100 turns the solenoid 113 on (operation S3). Thereby, the transfer gear 89 is meshed with the intermediate gear 90, and a rotational driving force of the motor 71 is transferred to the second feed roller 26 via the second driving-force transfer mechanism 121. As described above, even if the first feed roller 25 slips, a rotational driving force is instantly transferred to the second feed roller 26, thereby the recording sheet is always conveyed smoothly and stably. It is noted that where the rotating speed $V_1$ is judged to be less than or equal to the rotating speed $V_2$ in operation S2, the solenoid 113 is kept off, and the recording sheet is continuously conveyed only by the first feed roller 25 (operation S4).

In operation S5, it is determined whether the leading end of the recording sheet has arrived at a threshold position. The threshold position may be predetermined. This determination is made based on detection results of sheet sensors including an optical sensor installed in the sheet conveying path 23. In this instance, the threshold position is, for example, such a position that the recording sheet can be conveyed from the first feed roller 25 by a conveying roller 60 installed downstream in the conveying direction. When the leading end of the recording sheet has arrived at this threshold position, the recording sheet is conveyed by the conveying roller 60, and no switching of the transfer of a driving force by the solenoid 113 is performed. Therefore, if it is determined that the leading end of the recording sheet has arrived at the threshold position in operation S5, the process is complete and processing ends. If it is determined that the leading end of the recording sheet has not arrived at the threshold position ("No" in operation S5), processing returns to operation S2.

It is noted that in this exemplary embodiment, the rotating speed $V_1$ is compared with the rotating speed $V_2$, and it is determined whether the first feed roller 25 slips. However, whether the first feed roller 25 is slipping may also be determined based on whether the rotating speed $V_2$, which is calculated on the basis of a detection signal of the rotary encoder 116, is lower than a threshold (1) The embodiment is a sheet feeder for conveying sheets in the conveying direction. The sheet feeder is provided with a sheet tray, a first rotating body, a second rotating body and a conveying-force transfer means. The first rotating body and the second rotating body both impart a conveying force to sheets retained on the sheet tray. The conveying-force transfer means imparts a conveying force from the second rotating body to a sheet where the first rotating body slips on the sheet but does not impart a conveying force from the second rotating body to the sheet where the first rotating body does not slip on the sheet.

(2) The conveying-force transfer means is provided with a one-way clutch which transfers a rotational driving force in the conveying direction to the second rotating body and does not transfer a rotational driving force in a direction reverse to the conveying direction to the second rotating body but slips on a sheet.

Thereby, it is possible to mechanically constitute a mechanism which imparts a conveying force from the second rotating body to a sheet upon slippage of the first rotating body.

(3) A peripheral speed on driving the first rotating body is set to be greater than a peripheral speed on driving the second rotating body.

Thereby, where the first rotating body does not slip on a sheet, no rotational driving force is transferred to the second rotating body by the one-way clutch. Therefore, no deflection or pulling of the sheet between the first rotating body and the second rotating body is caused.

(4) The sheet feeder of the present invention is provided with a first arm member for supporting the first rotating body so as to rotate and additionally provided with a second arm member for supporting the second rotating body so as to rotate.

Thereby, it is possible to realize favorably the support of the first rotating body and the second rotating body.

(5) In the sheet feeder, a conveying force imparted from the second rotating body to a sheet is greater than a conveying force imparted from the first rotating body to a sheet.

Thereby, the sheet feeder is able to convey even a sheet, which cannot be conveyed by the first rotating body alone, by the second rotating body alone without a conveying force of the first rotating body. For example, where the first rotating body slips completely on a sheet, the second rotating body is able to convey the sheet reliably.

(6) A second angle of the second arm member in an extended direction with respect to the surface of a sheet retained on the sheet tray is greater than a first angle of the first arm member in an extended direction with respect to the surface of a sheet retained on the sheet tray.

Thereby, it is possible to concretely realize a mechanism in which a conveying force imparted to a sheet from the second rotating body is set to be greater than a conveying force imparted to a sheet from the first rotating body.

(7) It is preferable in realizing the present invention that the second rotating body is disposed apart upstream of the first rotating body in the conveying direction.

(8) The sheet feeder is additionally provided with a curved sheet conveying path through which sheets conveyed from the sheet tray are allowed to pass.

Where a sheet is conveyed by a device provided with the above-described sheet conveying path, a relatively great conveyance resistance is applied to the sheet. Therefore, the present invention is favorably applicable to such a sheet feeder.

What is claimed is:

1. A sheet feeder comprising:

a sheet tray which retains a sheet;

at least one driving source;

a first conveying mechanism comprising a first rotating body which is in contact with a sheet on the sheet tray and a first driving-force transfer mechanism which transfers a driving force of the driving source to the first rotating body; and a second conveying mechanism comprising a second rotating body which is in contact with the sheet on the sheet tray and a second driving-force transfer mechanism which transfers the driving force of the driving source to the second rotating body, wherein the second driving-force transfer mechanism comprises a one-way clutch configured to transfer the driving force of the driving source to the second rotating body under a predetermined condition;

wherein the first rotating body is rotated in a conveying direction of the sheet by the driving force directly transferred by the first driving-force transfer mechanism and not transferred through the one-way clutch, so that the sheet positioned on the sheet tray is conveyed in a predetermined direction at a first speed;

the second rotating body is rotated by a friction force between the sheet and the second rotating body and the driving force that is transferred through the one-way clutch is not transferred to the second rotating body, when a conveying speed of the sheet on the sheet tray is greater than a second speed which is smaller than the first speed; and the second rotating body is rotated in the conveying direction of the sheet by the driving force transferred by the one-way clutch of the second driving-force transfer mechanism, when the conveying speed of the sheet on the sheet tray is smaller than the second speed.

2. The sheet feeder according to claim 1, wherein a peripheral speed of the first rotating body which is driven by the driving source is greater than a peripheral speed of the second rotating body which is driven by the driving source.

3. The sheet feeder according to claim 1, wherein the first conveying mechanism further comprises a first arm member on which the first rotating body is provided so that the first rotating body may rotate;

the second conveying mechanism further comprises a second arm member on which the second rotating body is provided so that the second rotating body may rotate.

4. The sheet feeder according to claim 3, wherein an angle of an extending direction of the second arm member with respect to a surface of the sheet positioned on the sheet tray is greater than an angle of an extending direction of the first arm member with respect to the surface of the sheet positioned on the sheet tray.

5. The sheet feeder according to claim 1, wherein the second rotating body is disposed separate from and upstream of the first rotating body in the conveying direction of the sheet.

6. A sheet feeder comprising:

a sheet tray which retains a sheet;

at least one driving source;

a first conveying mechanism comprising a first rotating body which is in contact with a sheet on the sheet tray, a first driving-force transfer mechanism which transfers a driving force of the driving source to the first rotating body, and a first arm member on which the first rotating body is provided so that the first rotating body may rotate; and a second conveying mechanism comprising a second rotating body which is in contact with the sheet on the sheet tray, a second driving-force transfer mechanism which transfers the driving force of the driving source to the second rotating body, and a second arm member on which the second rotating body is provided so that the second rotating body may rotate, wherein the second driving-force transfer mechanism comprises a one-way clutch;

wherein the first rotating body is rotated in a conveying direction of the sheet by the driving force transferred by the first driving-force transfer mechanism, so that the sheet positioned on the sheet tray is conveyed in a predetermined direction at a first speed;

the second rotating body is rotated by a friction force between the sheet and the second rotating body and the driving force that is transferred through the one-way clutch is not transferred to the second rotating body, when a conveying speed of the sheet on the sheet tray is greater than a second speed which is smaller than the first speed;

the second rotating body is rotated in the conveying direction of the sheet by the driving force transferred by the one-way clutch of the second driving-force transfer mechanism, when the conveying speed of the sheet on the sheet tray is smaller than the second speed; and an angle of an extending direction of the second arm member with respect to a surface of the sheet positioned on the sheet tray is greater than an angle of an extending direction of the first arm member with respect to the surface of the sheet positioned on the sheet tray.

7. The sheet feeder according to claim 6, wherein a peripheral speed of the first rotating body which is driven by the driving source is greater than a peripheral speed of the second rotating body which is driven by the driving source.

8. The sheet feeder according to claim 6, wherein the second rotating body is disposed separate from and upstream of the first rotating body in the conveying direction of the sheet.

* * * * *